US010056216B2

(12) United States Patent
Chen et al.

(10) Patent No.: US 10,056,216 B2
(45) Date of Patent: Aug. 21, 2018

(54) GROUND FAULT TRIP ASSEMBLY

(71) Applicant: Eaton Corporation, Cleveland, OH (US)

(72) Inventors: Martin Chen, Shanghai (CN); Tom Xiong, Shanghai (CN); Kevin Zhong, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 137 days.

(21) Appl. No.: 15/242,707

(22) Filed: Aug. 22, 2016

(65) Prior Publication Data

US 2018/0053616 A1 Feb. 22, 2018

(51) Int. Cl.
*H01H 71/24* (2006.01)
*H01H 9/54* (2006.01)

(52) U.S. Cl.
CPC ..... *H01H 71/2463* (2013.01); *H01H 9/54* (2013.01)

(58) Field of Classification Search
CPC ..... H01H 71/2463; H01H 9/54
See application file for complete search history.

(56) References Cited

U.S. PATENT DOCUMENTS 3,383,959 A * 5/1968 Weglin ..... H02G 1/1212 76/107.1
5,508,670 A * 4/1996 Mantzouridis ..... H01H 71/126 335/172
5,686,709 A * 11/1997 Casagrande ..... H01H 71/1009 200/50.32
7,973,622 B2 * 7/2011 Yang ..... H01H 9/0066 200/308
9,384,910 B1 * 7/2016 Kline ..... H01H 73/38
2009/0050460 A1 * 2/2009 Ahn ..... H01H 3/46 200/400
2014/0054148 A1 * 2/2014 Marushima ..... H01H 3/32 200/400

* cited by examiner

*Primary Examiner* — Bernard Rojas
(74) *Attorney, Agent, or Firm* — Eckert Seamans

(57) ABSTRACT

A trip bar cam unit for a trip bar is provided. The trip bar cam unit includes a trip bar cam unit body, a cam lever, and a keyed protrusion. The trip bar cam unit body defines an axis of rotation. The cam lever extends generally radially from the trip bar cam unit body. The keyed protrusion corresponds to a trip bar axial bore.

15 Claims, 7 Drawing Sheets

GROUND FAULT TRIP ASSEMBLY

BACKGROUND OF THE INVENTION

Field of the Invention

The disclosed and claimed concept relates to a circuit breaker and, more particularly, to a ground fault trip assembly for a circuit breaker.

Background Information

Circuit breakers are well known and are in general use. Generally, circuit breakers are disposed in a remote location and a typical person does not interact with a circuit breaker on a daily basis. Electric vehicles and similar devices need to be charged by a user. The charging stations for such vehicles include circuit breakers, also known as the Energy Management Circuit Breaker (EMCB) or the Power Vending Machine (PVM) Circuit Breaker, for the protection of the user. Thus, with the rise in popularity of electric vehicles, a typical person who uses such a vehicle will be in close proximity to circuit breakers. Such circuit breakers, while safe and while protecting equipment and people downstream of the circuit breaker, can be improved upon to react in less time and thereby become even safer.

There is, therefore, a need for an improved circuit breaker structured to trip the circuit breaker within an effective response time. There is a further need to adapt existing circuit breakers to trip the circuit breaker within an effective response time.

SUMMARY OF THE INVENTION

These needs, and others, are met by at least one embodiment of this invention which provides a trip bar cam unit for a trip bar. The trip bar cam unit includes a trip bar cam unit body, a cam lever, and a keyed protrusion. The trip bar cam unit body defines an axis of rotation. The cam lever extends generally radially from the trip bar cam unit body. The keyed protrusion corresponds to a trip bar axial bore. In this configuration, the trip bar cam unit is structured to be coupled, directly coupled, or fixed to a trip bar in a circuit breaker. The trip bar cam unit operates with a ground-fault solenoid and a ground-fault solenoid control unit.

In this configuration, as described below, the trip bar cam unit, as well as the ground-fault solenoid and a ground-fault solenoid control unit, solve the problems stated above.

BRIEF DESCRIPTION OF THE DRAWINGS

A full understanding of the invention can be gained from the following description of the preferred embodiments when read in conjunction with the accompanying schematic drawings in which.

DESCRIPTION OF THE PREFERRED EMBODIMENTS

Figure 1:
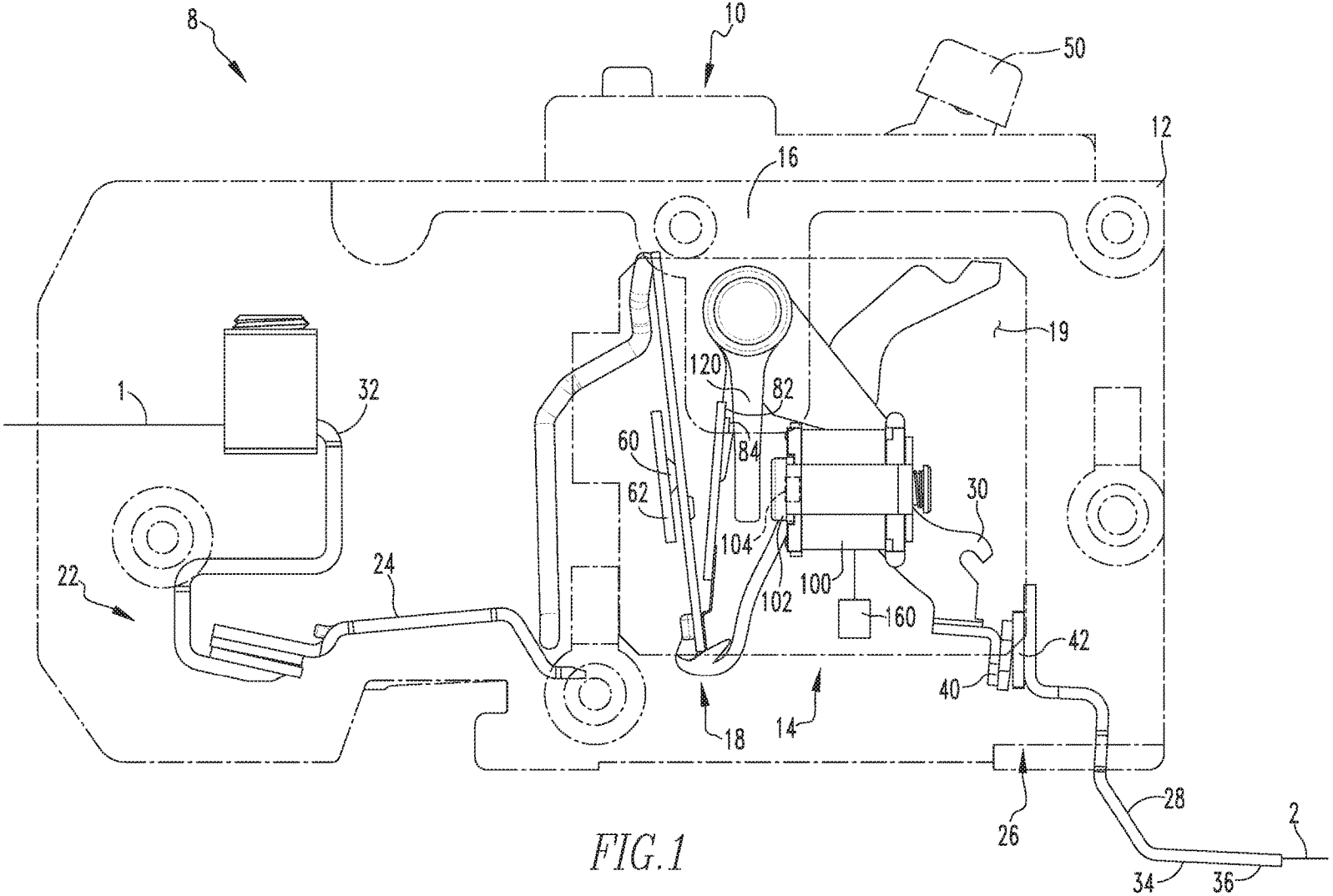
FIG. 1 is a cross-sectional side view of a circuit breaker in a second configuration.
Figure 2:
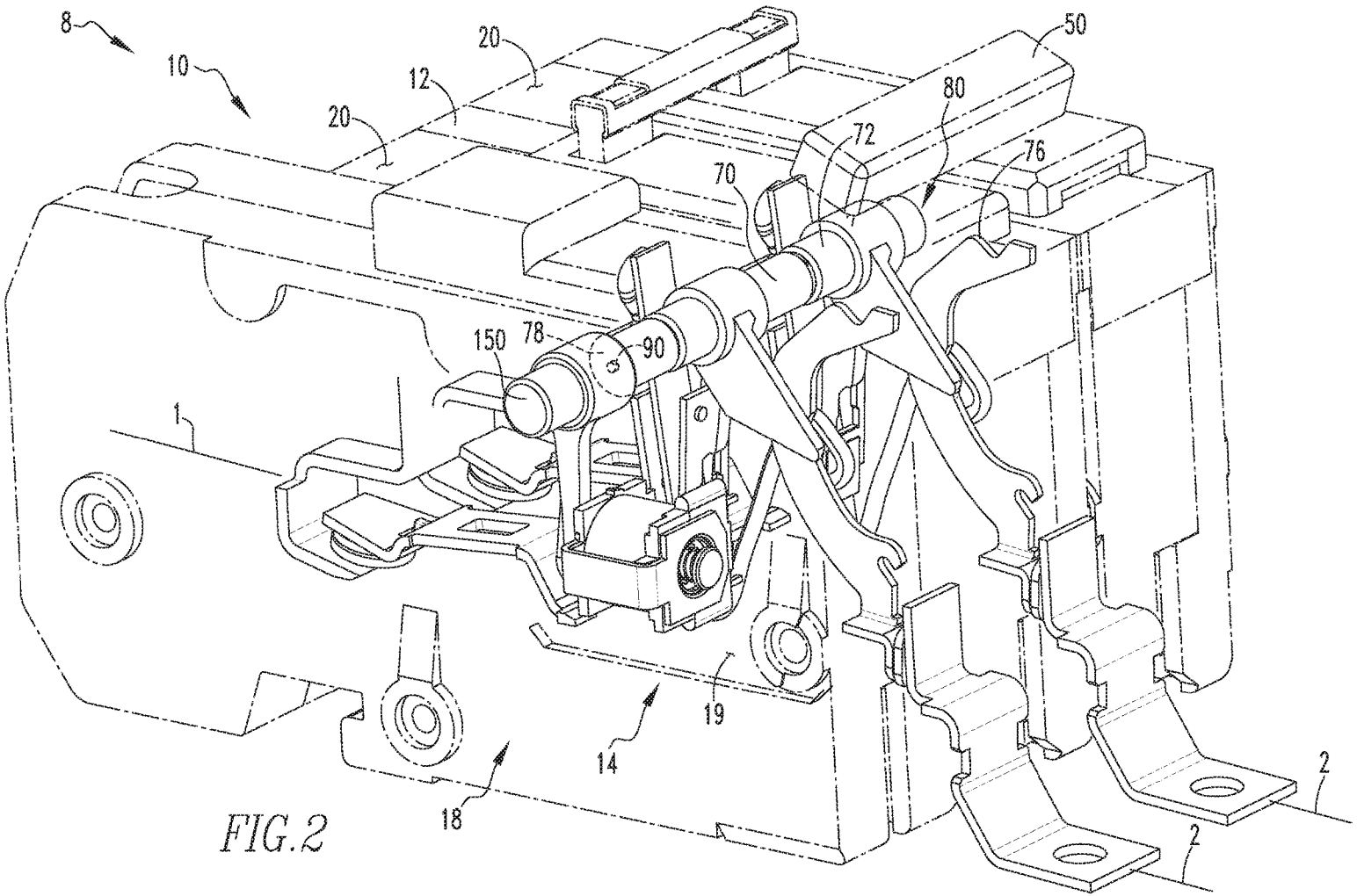
FIG. 2 is a partial cut away isometric view of a circuit breaker in a second configuration.
Figure 3:
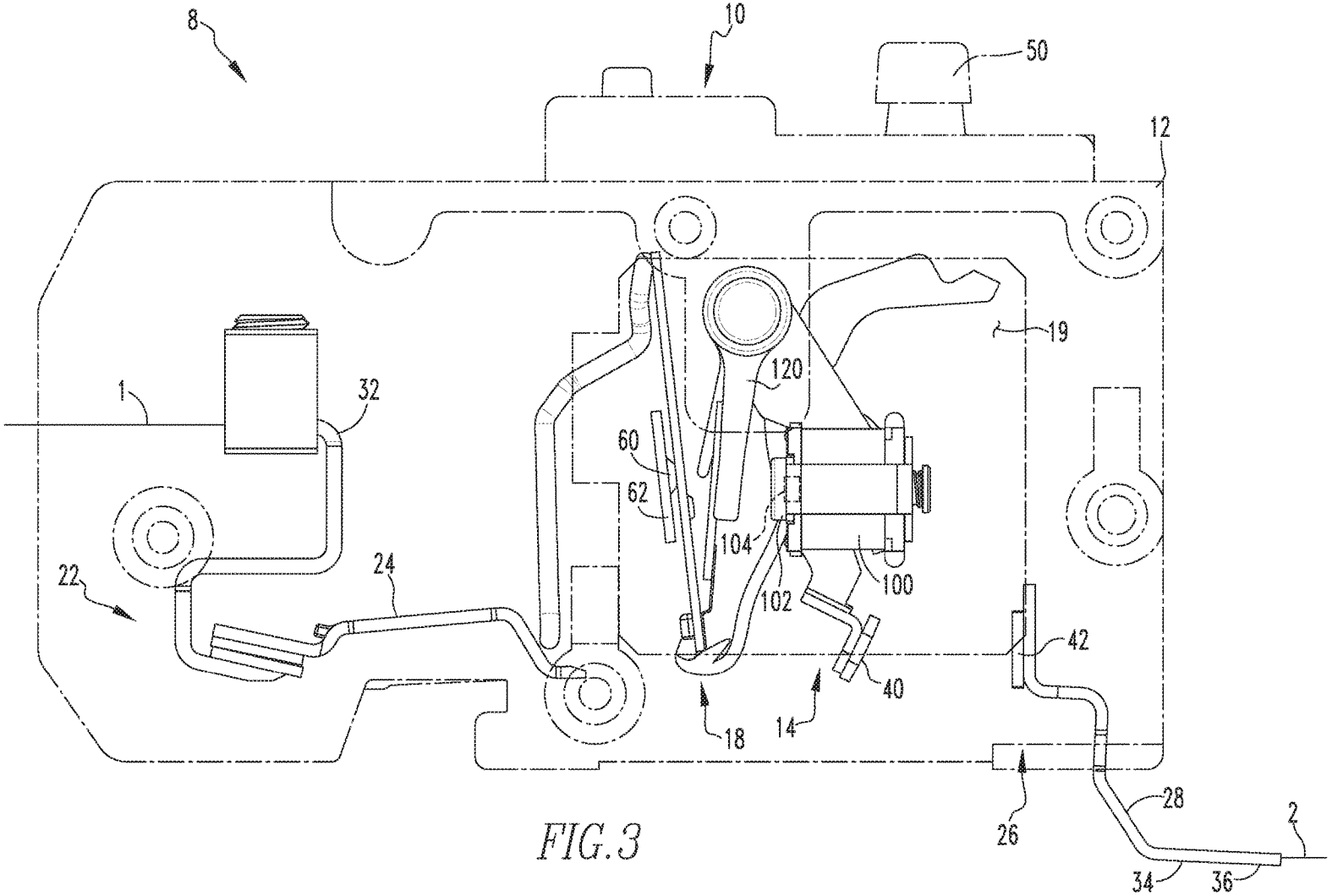
FIG. 3 is a cross-sectional side view of a circuit breaker in a first configuration.
Figure 4:
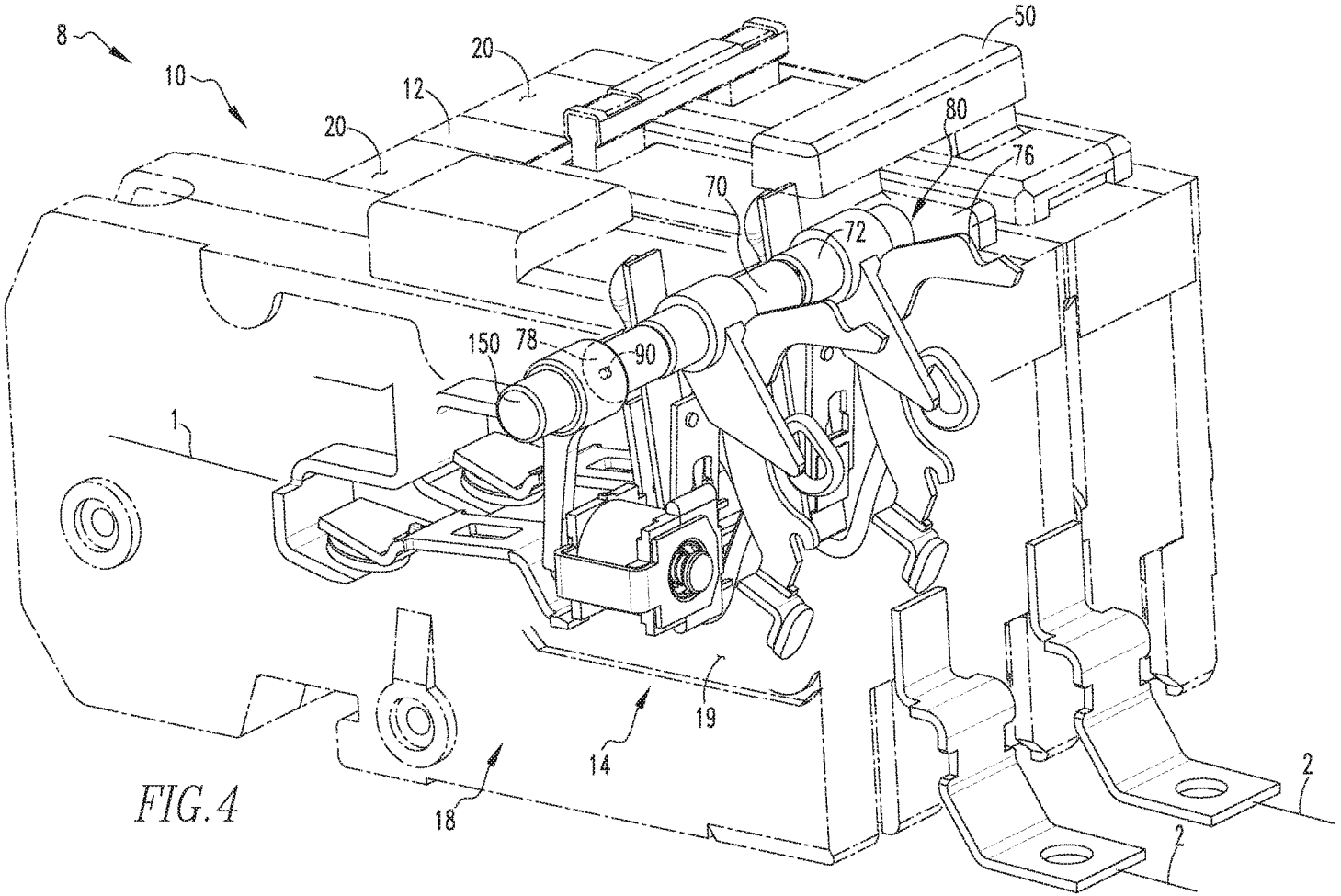
FIG. 4 is a partial cut away isometric view of a circuit breaker in a first configuration.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap protrusion, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. Further, as used herein, "loosely correspond" means that a slot or opening is sized to be larger than an element disposed therein. This means that the increased size of the slot or opening is intentional and is more than a manufacturing tolerance. With regard to surfaces, shapes, and lines, two, or more, "corresponding" surfaces, shapes, or lines have generally the same size, shape, and contours. With regard to positions and configurations, "correspond" means that different elements or assemblies are in a position/configuration of the same name at the same time. That is, if a first assembly moves between a first configuration and a second configuration, and a second assembly moves between "corresponding" first and second configurations, that means that when the first assembly is in the first configuration, then the second assembly is also in the first configuration, and, when the first assembly moves to the second configuration, then the second assembly also moves to the second configuration. It is understood that the movement does not have to be instant or simultaneous, but that when the first assembly is in a stated configuration, the second assembly is in, or is moving toward, its "corresponding" configuration.

As used herein, a "path of travel" or "path," when used in association with an element that moves, includes the space an element moves through when in motion. As such, any element that moves inherently has a "path of travel" or "path." When used in association with an electrical current, a "path" includes the elements through which the current travels.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means for the most part, by a large amount or degree. Thus, for example, a first element "substantially" disposed in a second element is, for the most part, disposed in the second element.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, when elements are in "electrical communication" a current may flow between the elements. That is, when a current is present and elements are in "electrical communication," then the current flows between the elements. It is understood that elements that are in "electrical communication" have, in some embodiments, a number of conductive elements, or other constructs, disposed therebetween creating the path for the current.

As shown in FIGS. 1-4, and as is known, an electrical switching apparatus 8, such as, but not limited to a circuit breaker 10, includes a housing assembly 12, a conductor assembly 14, an operating mechanism 16 (shown schematically), a trip assembly 18, (some elements shown schematically) as well as other components. The housing assembly 12 is made from a non-conductive material and defines an enclosed space 19 wherein the other components may be disposed. The housing assembly enclosed space 19 is, in an exemplary embodiment, divided into a number of cavities 20. In an exemplary embodiment, the housing assembly 12 includes a first housing 11 and a second housing 13. The second housing 13 is coupled, directly coupled, or fixed to the first housing 11. The conductor assembly 14 is disposed in the cavity 20 defined by the first housing 11. The GF solenoid 100 and the trip bar cam unit 120, both described below, are disposed in the cavity 20 of the second housing 13. Thus, in an exemplary embodiment, the first housing 13 includes a first sidewall 15 which is disposed immediately adjacent the second housing 11. The first housing first sidewall 15 includes a passage 17 structured to, and does, allow a portion of the trip bar 70, i.e., the trip bar body 72, and/or the trip bar cam unit 120 (both described below) to extend therethrough.

The conductor assembly 14 includes a number of sets of conductive elements 22 that extend through the housing assembly 12. That is, the conductive elements 22 are substantially disposed in the housing assembly enclosed space 19. The elements in a set of conductive elements 22 are substantially similar and only one set of conductive elements 22 is described. If needed, the elements of different sets of conductive elements 22 may be distinguished by a reference number followed by a letter, e.g., contacts "25A," "25B," etc.

The conductive elements 22 extend in a longitudinal direction through the housing assembly 12. As shown, the number of conductive elements 22 include, but are not limited to, a movable contact bus assembly 24, a pair of contacts 26 and a fixed contact bus assembly 28. Each movable contact bus assembly 24 includes a movable contact bus 30 having a movable contact bus terminal end 32 that extends outside the housing assembly enclosed space 19. Each fixed contact bus assembly 28 includes a fixed contact bus 34 having a fixed contact terminal end 36 that extends outside the housing assembly enclosed space 19. Each pair of contacts 26 includes a movable contact 40 (which is also an element of the movable contact bus assembly 24) and a fixed contact 42 (which is also an element of the fixed contact bus assembly 28). Each movable contact 40 is structured to move between an open, first position, wherein the movable contact 40 is spaced from the fixed contact 42, and, a closed, second position, wherein the movable contact 40 is directly coupled to, and in electrical communication with, the fixed contact 42. In an exemplary embodiment, the movable contact bus assembly 24 is coupled to, and in electrical communication with, a line conductor 1 (shown schematically), and, the fixed contact bus assembly 28 is coupled to, and in electrical communication with, a line conductor (shown schematically) 1.

The operating mechanism 16 is coupled to each movable contact 40 and is structured to move each movable contact 40. The operating mechanism 16 moves between a number of configurations including an open, first configuration, wherein each movable contact 40 is spaced from, and not in electrical communication with, an associated fixed contact 42, a tripped configuration, wherein each movable contact 40 is spaced from, and not in electrical communication with, an associated fixed contact 42, and, a closed, second configuration, wherein each movable contact 40 is directly coupled to, and in electrical communication with, the associated fixed contact 42. The operating mechanism 16 includes biasing elements (not shown) such as, but not limited to springs (not shown), that bias the operating mechanism 16 to the first and/or tripped configuration. Thus, the contacts 40, 42 are biased to the open, first position wherein the contacts 40, 42 are not in electrical communication. The operating mechanism 16 includes a handle 50 that may be used to move the contacts 40, 42 between the first and second positions. In an exemplary embodiment, the operating mechanism 16 and the handle 50 also move to a reset configuration and position, respectively. Moving the operating mechanism 16 into the reset configuration includes, in an exemplary embodiment, first moving the operating mechanism 16 and the handle 50 to the first configuration/position. Thus, the mechanism 16 and the handle 50 to the first configuration/position is also, as used herein, a preliminary reset configuration/position, as is known. Handle 50 extends through an opening in housing assembly 12. The handle 50 moves, and in an exemplary embodiment, pivots about its lower end which is disposed in the housing assembly enclosed space 19. The operating mechanism 16 also includes a number of catch surfaces 82 that operatively engage, or are operatively engaged by, trip assembly latch members 84, described below.

The trip assembly 18 (partially shown in schematic) is structured to detect an overcurrent condition and to operatively engage the operating mechanism 16. That is, as is known, the trip assembly 18 includes a number of overcurrent detection assemblies 60, such as, but not limited to, thermally actuated overcurrent detection assemblies 62 and magnetically actuated overcurrent detection assemblies (not shown). Each overcurrent detection assembly 60 includes, or is operatively coupled to, a trip assembly latch member 84, discussed below. As is known, when the operating mechanism 16 is in the second configuration, a trip assembly latch member 84 operatively engages, or is operatively engaged by, an operating mechanism catch surface 82. That is, the trip assembly latch member 84 prevents, or resists, movement of the operating mechanism 16 due to the biasing elements. When an overcurrent condition is detected, an overcurrent detection assembly 60 operatively engages the trip assembly latch member 84 causing the trip assembly latch member 84 to disengage from the associated operating mechanism catch surface 82. When the trip assembly latch member 84 no longer holds the associated operating mechanism catch surface 82, the biasing elements cause the operating mechanism 16 to move to the first configuration which, in turn, moves the movable contact 40 to the first position.

Figure 5:
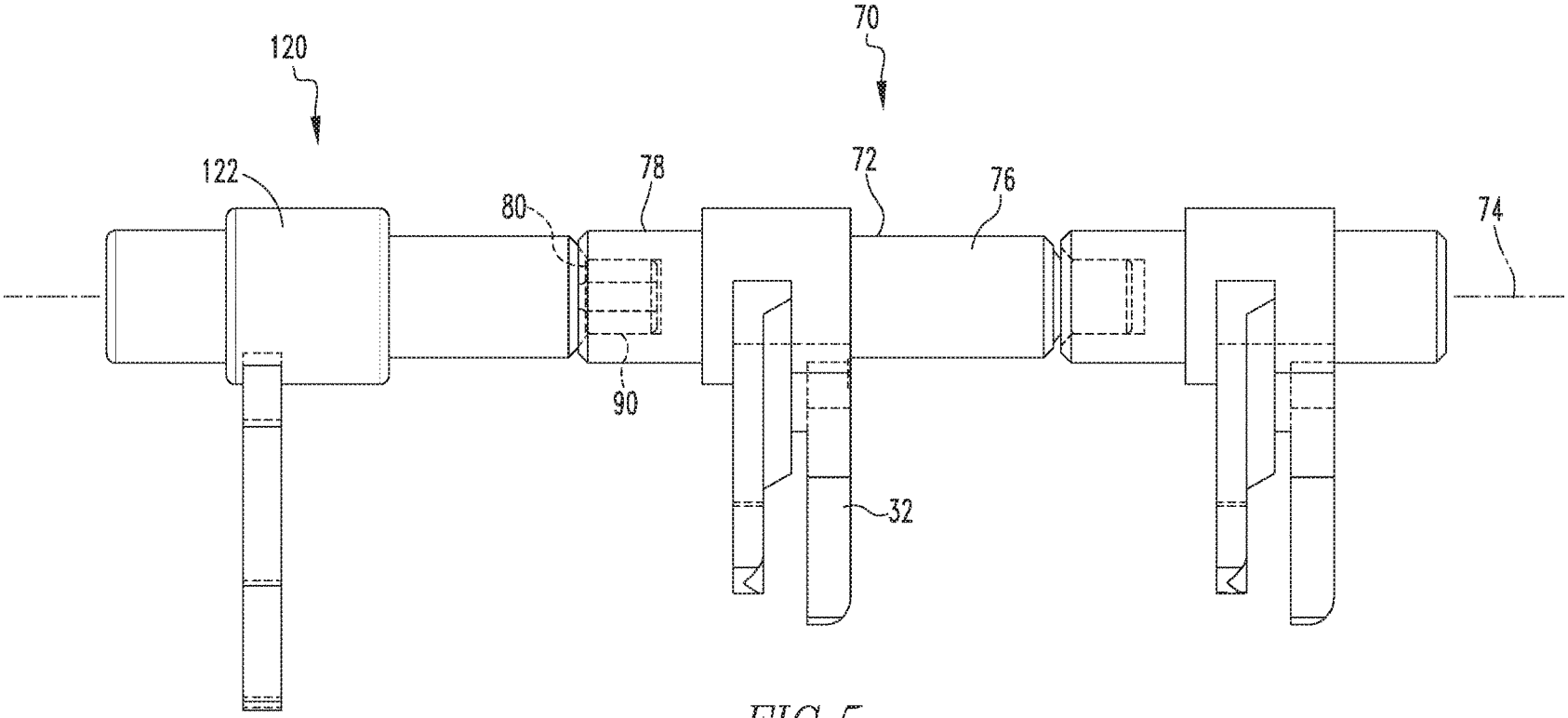
FIG. 5 is a front view of a trip bar and trip bar cam unit.

A trip bar 70, shown in FIG. 5, defines a number of catch surfaces 82. That is, the trip bar 70 is one interface between the operating mechanism 16 and the trip assembly 18. As such, as used herein, the trip bar 70 is identified as part of both the operating mechanism 16 and the trip assembly 18.

Thus, the "operating mechanism catch surface(s) 82 recited above are also, as used herein, "trip bar catch surfaces 82." The trip bar 70 includes an elongated body 72 having an axis of rotation 74, a radial surface 76 a first end 78 and a first axial surface 80. The trip bar body first axial surface 80 is disposed on the trip bar body first end 78. As used herein, the "radial surface" is the surface that extends about the trip bar body axis of rotation 74, and, the "axial surfaces" are the end surfaces extending generally perpendicular to the trip bar body axis of rotation 74. The trip bar body 72 is rotatably coupled to the housing assembly 12. The trip bar body 72 is structured to, and does, rotate between a number of positions including a first position a trip position, and a second position corresponding the operating mechanism 16 first, trip and second configurations. In an exemplary embodiment, the trip bar body 72 is structured to, and does, rotate to a reset position corresponding to the operating mechanism 16 reset configuration. The trip bar body radial surface 76 defines a number of catch surfaces 82. The catch surfaces 82 are, in an exemplary embodiment, disposed on radial lever arms and are also known in the art as "cam surfaces." Other portions of the trip bar body radial surface 76 are generally circular. That is, in an exemplary embodiment, and with the exception of the lever arms defining the catch surfaces 82, the trip bar body 72 includes a generally circular radial surface 76.

In an exemplary embodiment, the trip bar body 72 is substantially disposed in the cavity 20 defined by the first housing 11 with the trip bar body first end 78 extending through the first housing first sidewall passage 17 and into the cavity 20 of the second housing 13. Thus, the trip bar body first axial surface 80 is disposed in the cavity 20 of the second housing 13.

The trip bar body first axial surface 78 defines a keyed bore 90. The keyed bore 90 is a bore having a shape other than circular or substantially circular. The keyed bore 90 is structured to, and does, mate to a keyed protrusion 128 on a trip bar cam unit 120, described below, and having a corresponding shape. Because the keyed bore 90 and keyed protrusion 128 are not circular or substantially circular, the keyed protrusion 128 cannot rotate in the keyed bore 90; thus, when coupled, the trip bar 70 and the trip bar cam unit 120 are fixed to each other. That is, the trip bar 70 and the trip bar cam unit 120 cannot rotate relative to each other. Further, it is understood that the locations of the keyed bore 90 and keyed protrusion 128 are reversible. That is, in another embodiment, the keyed protrusion 128 could be disposed on, or unitary with, the trip bar body first axial surface 78 and the keyed bore 90 could be on the trip bar cam unit body 122, described below.

In an exemplary embodiment, the trip assembly 18 further includes a ground-fault solenoid 100 (hereinafter "GF solenoid"). The GF solenoid 100 includes a coil (not shown) disposed about a plunger 102. As is known, when the GF solenoid coil is energized, a magnetic field is generated and which causes the GF solenoid plunger 102 to move. That is, the GF solenoid plunger 102 is structured to, and does, move between an extended, first position and a retracted, second position. The GF solenoid plunger 102 includes an "engagement end" 104 which, as used herein, is the end of the GF solenoid plunger 102 that extends outside of the GF solenoid coil. As noted above, and in an exemplary embodiment, the GF solenoid 100 is disposed in the cavity 20 of the second housing 13.

Figure 6:
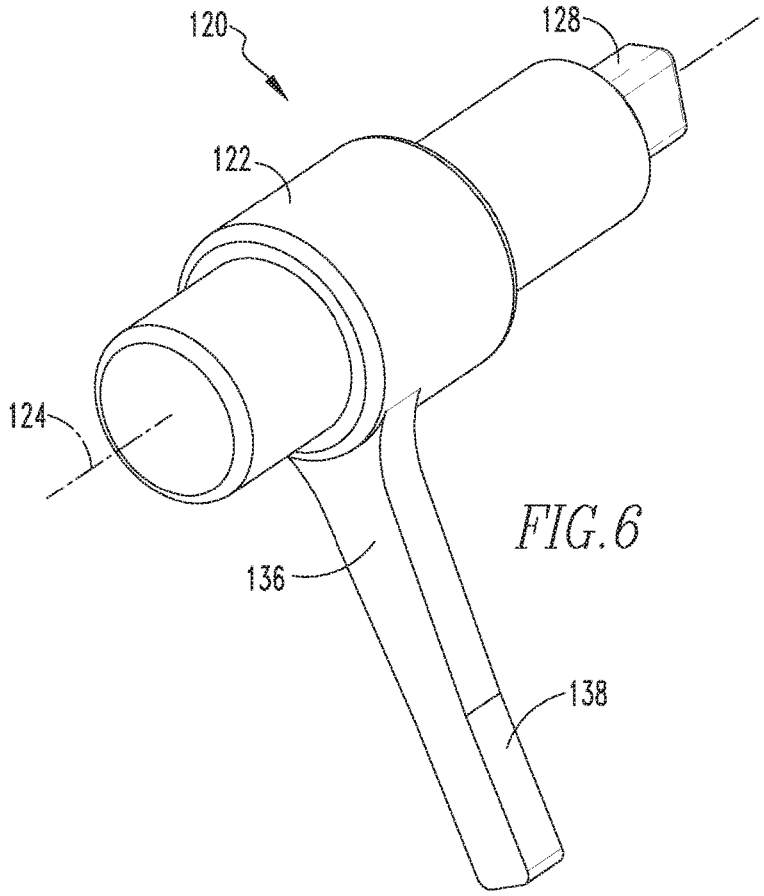
FIG. 6 is an isometric view of a trip bar cam unit.
Figure 7:
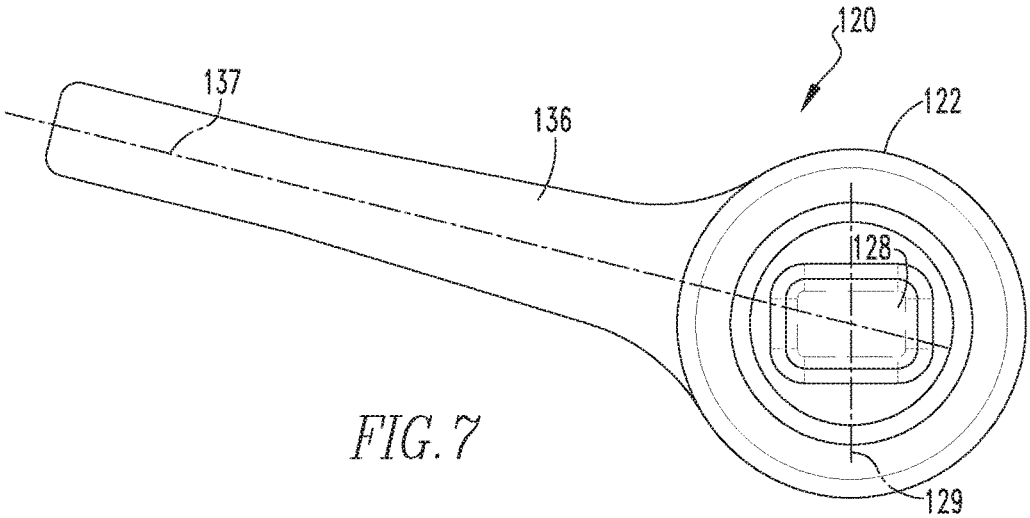
FIG. 7 is an end view of a trip bar cam unit.

In an exemplary embodiment, the trip assembly 18 further includes a "trip bar cam unit" 120. As used herein, and as shown in FIGS. 6 and 7, a "trip bar cam unit" 120 is a construct that is structured to be, and is, coupled, directly coupled, or fixed to the trip bar body 72. The trip bar cam unit body 122 includes a cam surface, i.e., the cam lever engagement surface 138 (described below) that, when operatively engaged, causes the trip bar body 72 to rotate. The trip bar cam unit 120, in an exemplary embodiment, includes a unitary body 122. The trip bar cam unit body 122 defines an axis of rotation 124 and includes a cam lever 136 and a keyed protrusion 128. In an exemplary embodiment, the cam lever 136 extends generally radially from the trip bar cam unit body 122. That is, the cam lever 136 extends generally perpendicular to the trip bar cam unit body axis of rotation 124. The cam lever 136 is, in an exemplary embodiment, unitary with the trip bar cam unit body 122. The cam lever 136 includes an engagement surface 138. In an exemplary embodiment, the cam lever engagement surface 138 is disposed near the distal end of the cam lever 136. The trip bar cam unit body 122 is structured to be, and is, coupled to the trip bar 70, i.e., the trip bar body 72, so that the cam lever engagement surface 138 is disposed an "effective distance" from the GF solenoid plunger engagement end 104 when the trip bar 70 is in its second position.

That is, as is known, solenoids such as the GF solenoid 100 have operational characteristics. These characteristics include, but are not limited to, the distance the plunger travels between the first and second positions, as used herein the "stroke distance," and the time it takes the plunger to travel between the first and second positions, as used herein the plunger "response time." A solenoid plunger, however, is positioned a selected distance from the element(s) it operatively engages. That is, a solenoid plunger may be positioned to operatively engage an element(s) somewhere in the middle of the stroke distance. Thus, the plunger has, as used herein, an "effective stroke" which means the distance traveled by the plunger before the plunger operatively engages another element(s). This positioning, in turn, creates, as used herein, an "effective response time" for the plunger which is the time it takes for the plunger to move from the second position to the first position. Thus, as used herein an "effective distance" means a distance which places the element(s) the plunger operatively engages in a position so that the "effective response time" is 8 milliseconds (ms) or less. As described below, in an exemplary embodiment, the GF solenoid plunger 102, and as shown the GF solenoid plunger engagement end 104, is structured to, and does, operatively engage the cam lever engagement surface 138. Thus, in an exemplary embodiment, the GF solenoid plunger engagement end 104 is disposed an "effective distance" from the cam lever engagement surface 138. This configuration solves the problems stated above.

In an exemplary embodiment, the keyed bore 90 and keyed protrusion 128 each have a generally rectangular shape. In this shape, each of the keyed bore 90 and keyed protrusion 128 have a first cross-sectional axis 91, 129, respectively. The keyed bore and keyed protrusion first cross-sectional axis 91, 129 generally correspond to each other. That is, when the keyed protrusion 128 is in the keyed bore 90, the keyed bore and keyed protrusion first cross-sectional axis 91, 129 are generally aligned or are parallel. Further, in this embodiment, the cam lever 136 is elongated and has a longitudinal axis 137. The cam lever longitudinal axis 137 is disposed at an angle of between about 94 degrees to about 114 degrees, or about 104 degrees, relative to the keyed protrusion first cross-sectional axis 129.

The trip bar cam unit 120 is, in an exemplary embodiment, fixed to the trip bar body 72 to form a trip bar assembly 150. The trip bar assembly 150 is rotatably coupled to the housing assembly 12 within the housing assembly enclosed space 19. When so disposed, the cam lever engagement surface 138 is disposed an effective distance from the GF solenoid plunger engagement end 104. In an exemplary embodiment, the distance between the cam lever engagement surface 138 and the GF solenoid plunger engagement end 104, when the trip bar body 72 is in the second position is between about 1.0 mm and 1.4 mm, or about 1.2 mm. That is, in an exemplary embodiment, the "effective distance" is between about 1.0 mm and 1.4 mm, or about 1.2 mm. This configuration solves the problems stated above.

Figure 8:
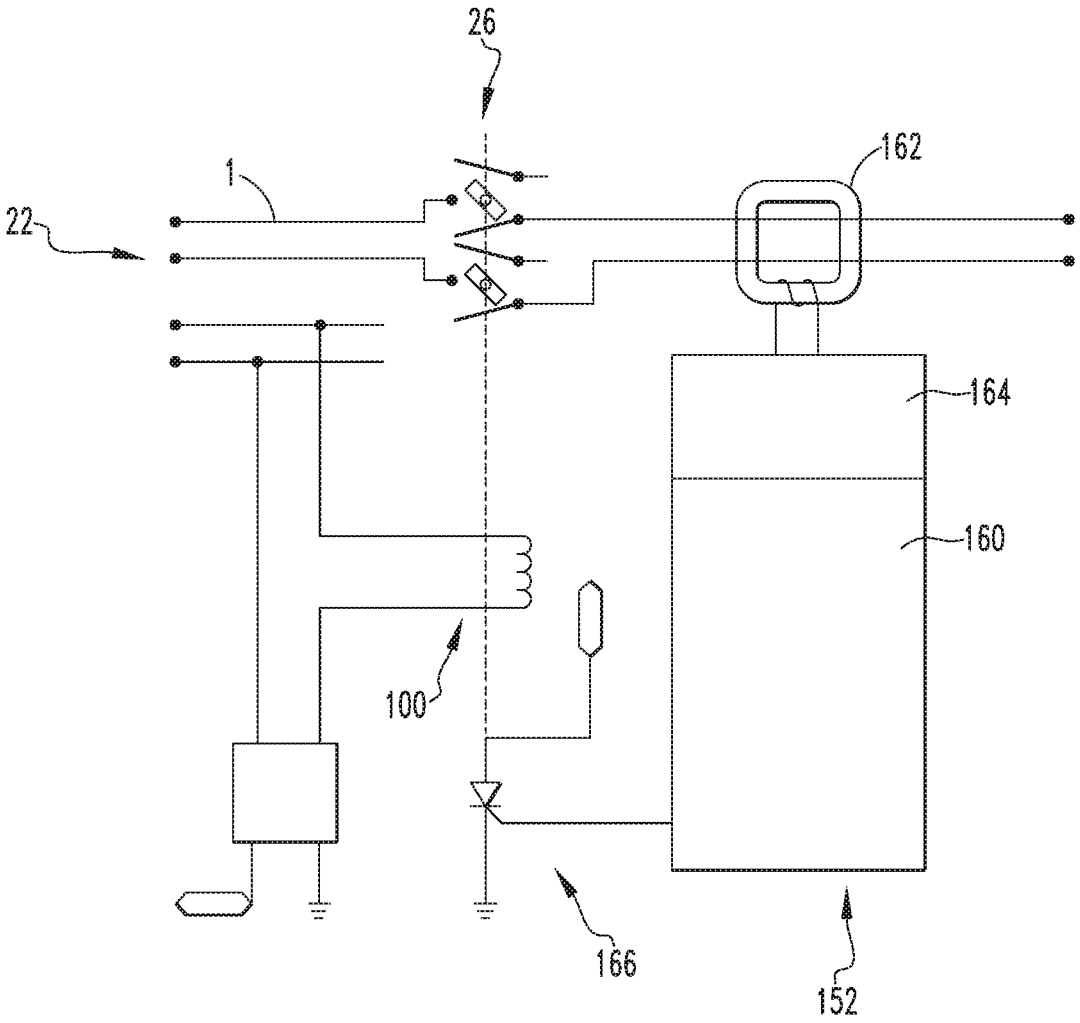
FIG. 8 is a schematic view of a GF solenoid control unit.

The trip bar assembly 150 is operatively coupled to, and is also, as used herein, part of a ground fault trip assembly 152 that is a subcomponent of the trip assembly 18. In an exemplary embodiment, as shown in FIGS. 7 and 8, the ground fault trip assembly 152 includes the GF solenoid 100 and the trip bar cam unit 120, described above, as well as a GF solenoid control unit 160. The GF solenoid control unit 160 is structured to actuate the GF solenoid plunger 102 within a "first effective response time." In an exemplary embodiment, and as used herein, a "first effective response time" means between about 4 ms and 8 ms.

In an exemplary embodiment, the GF solenoid control unit 160 includes a GF coil 162, a Programmable Logic Circuit (hereinafter "PLC") 164, and a silicon controlled rectifier/semiconductor-controlled rectifier (hereinafter "SCR") gate drive 166. The GF coil 162 is disposed about a number of the load conductors 2. As is known, the GF coil 162 responds to electromagnetic changes in the load conductors 2. That is, the GF coil 162 is structured to generate a GF signal when a ground fault occurs in any load conductor 2. The said GF solenoid control unit PLC 164 is coupled to, and in electrical communication with, the GF coil 162. The GF solenoid control unit PLC 164 is structured to receive the GF signal from the GF coil 162. The GF solenoid control unit PLC 164 is further structured to produce an actuation signal upon receiving the GF signal. The SCR gate drive 166 is coupled to, and in electrical communication with, the GF solenoid control unit PLC 164. The SCR gate drive 166 is structured to, and does, receive the GF solenoid control unit PLC actuation signal. The SCR gate drive 166 is further coupled to, and in electrical communication with, said GF solenoid 100. The SCR gate drive 166 is structured to, and does, charge the GF solenoid 100 upon receiving the GF solenoid control unit PLC actuation signal.

Thus, during normal operation, the operating mechanism 16 is in the second configuration and each pair of contacts 26 has the movable contact 40 in the second position. After an overcurrent condition is detected by the trip assembly 18, including a ground fault detected by the ground fault trip assembly 152, the trip bar 70 moves to the first position. As described above, the motion of the trip bar 70 releases the operating mechanism 16 which moves to the tripped configuration. The movement of the operating mechanism 16 moves each pair of contacts 26 to the first position. At this point, the circuit breaker 10 is "tripped" and no electricity passes from the line conductors 1 to the load conductors 2. A user then moves the operating mechanism 16 to the reset configuration which, as described above and in an exemplary embodiment, includes moving the operating mechanism 16 to the first configuration before moving to the reset configuration. As is known, movement of the operating mechanism 16 is accomplished by moving the handle 50 to the corresponding positions.

Further, in an exemplary embodiment, the GF solenoid 100 is not in direct electrical communication with the conductor assembly 14. That is, the GF solenoid 100 is not powered by the conductor assembly 14. Further, in an exemplary embodiment, the GF solenoid control unit 160 is not in direct electrical communication with the conductor assembly 14. That is, the GF solenoid control unit 160 is not powered by the conductor assembly 14.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A trip bar cam unit for a trip bar, said trip bar for a circuit breaker, said trip bar including an elongated body, said trip bar body including a first axial surface, defining a number of cam surfaces and an axis of rotation, said trip bar body first axial surface defining a keyed bore, said trip bar body structured to rotate between a number of positions including a first position and a second position, said circuit breaker including a housing assembly, a conductor assembly, a trip assembly, and an operating mechanism, said housing assembly defining an enclosed space, said conductor assembly substantially disposed within said housing assembly enclosed space, said conductor assembly including a movable contact bus assembly, a number of pairs of separable contacts, and a fixed contact bus assembly, each pair of separable contacts including a fixed contact and a movable contact, wherein each said movable contact moves between a first position, wherein said movable contact is spaced from, and not in electrical communication with, an associated fixed contact, and a second position, wherein said movable contact is coupled to, and in electrical communication with, an associated fixed contact, said trip assembly including said trip bar, a Ground Fault (GF) solenoid, and an over-current detection assembly, said GF solenoid including a plunger structured to move between an extended, first position and a retracted, second position, said GF solenoid plunger including an engagement end, said over-current detection assembly operatively coupled to said trip bar, said operating mechanism operatively coupled to each said pair of contacts and structured to move each said pair of contacts between said first and second positions, said trip bar operatively coupled to said operating mechanism and structured to cause said operating mechanism to move each said pair of contacts from said second position to said first position, said trip bar cam unit comprising:

a trip bar cam unit body defining an axis of rotation, said trip bar cam unit body including a cam lever and a keyed protrusion;

said cam lever extending generally radially from said trip bar cam unit body;

said keyed protrusion corresponding to said trip bar keyed bore;

said cam lever includes an engagement surface; and said trip bar cam unit body is structured to be coupled to said trip bar so that said cam lever engagement surface is disposed an effective distance from said GF solenoid plunger engagement end when said trip bar is in said second position.

2. The trip bar cam unit of claim 1 wherein:

said cam lever includes an engagement surface; and said trip bar cam unit body is structured to be fixed to said trip bar so that said cam lever engagement surface is disposed an effective distance from said GF solenoid plunger engagement end when said trip bar is in said second position.

3. The trip bar cam unit of claim 2 wherein, said trip bar keyed bore is generally rectangular and has a first cross-sectional axis, and wherein:

said keyed protrusion is generally rectangular and has a first cross-sectional axis generally corresponding to said trip bar keyed bore first cross-sectional axis;

said cam lever is elongated and defines a longitudinal axis; and said cam lever longitudinal axis disposed at an angle of between about 94 degrees to about 114 degrees relative to said keyed protrusion first cross-sectional axis.

4. The trip bar cam unit of claim 1 wherein said elongated trip bar cam unit body includes a generally circular radial surface.

5. A circuit breaker comprising:

a housing assembly defining an enclosed space;

a conductor assembly including a movable contact bus assembly, a number of pairs of separable contacts, and a fixed contact bus assembly, said conductor assembly substantially disposed in said housing assembly enclosed space;

each pair of separable contacts including a fixed contact and a movable contact, wherein each said movable contact moves between a first position, wherein said movable contact is spaced from, and not in electrical communication with, an associated fixed contact, and a second position, wherein said movable contact is coupled to, and in electrical communication with, an associated fixed contact;

a trip assembly, said trip assembly including a trip bar, an over-current detection assembly, a Ground Fault (GF) solenoid and a trip bar cam unit;

said over-current detection assembly operatively coupled to said trip bar;

an operating mechanism, said operating mechanism operatively coupled to each said pair of contacts and structured to move each said pair of contacts between said first and second positions;

said trip bar including an elongated body with a first end, a first axial surface, and defining a number of cam surfaces and an axis of rotation;

said trip bar body structured to rotate between a number of positions including a first position and a second position;

said trip bar operatively coupled to said operating mechanism and structured to cause said operating mechanism to move each said pair of contacts from said second position to said first position;

said GF solenoid including a plunger structured to move between an extended, first position and a retracted, second position;

said GF solenoid plunger including an engagement end;

said trip bar cam unit including a body defining an axis of rotation;

said trip bar cam unit body including a cam lever;

said cam lever extending generally radially from said trip bar cam unit body;

said trip bar cam unit body coupled to said trip bar;

said cam lever includes an engagement surface; and said trip bar cam unit body coupled to said trip bar so that said cam lever engagement surface is disposed an effective distance from said GF solenoid plunger engagement end when said trip bar is in said second position.

6. The circuit breaker of claim 5 wherein:

said cam lever includes an engagement surface; and said trip bar cam unit body is structured to be fixed to said trip bar so that said cam lever engagement surface is disposed an effective distance from said GF solenoid plunger engagement end when said trip bar is in said second position.

7. The circuit breaker of claim 6 wherein the distance between said cam lever engagement surface and said GF solenoid plunger engagement end when said trip bar body is in said second position is between about 1.0 mm and 1.4 mm.

8. The circuit breaker of claim 6 wherein the distance between said cam lever engagement surface and said GF solenoid plunger engagement end when said trip bar body is in said second position is about 1.2 mm.

9. The circuit breaker of claim 5 wherein:

said housing assembly including a first housing and a second housing;

said first housing including a first sidewall with a passage;

said trip bar first end extending through said first housing first sidewall passage;

said trip bar first axial surface including a keyed bore;

said trip bar cam unit body including a keyed protrusion, said keyed protrusion corresponding to said trip bar keyed bore; and said trip bar cam unit body fixed to said trip bar at said trip bar first end.

10. The circuit breaker of claim 9 wherein:

said trip bar keyed bore is generally rectangular and has a first cross-sectional axis;

said keyed protrusion is generally rectangular and has a first cross-sectional axis generally corresponding to said trip bar keyed bore first cross-sectional axis;

said cam lever is elongated and defines a longitudinal axis; and said cam lever longitudinal axis disposed at an angle of between about 94 degrees to about 114 degrees relative to said keyed protrusion first cross-sectional axis.

11. The circuit breaker of claim 5 wherein said elongated trip bar cam unit body includes a generally circular radial surface.

12. The circuit breaker of claim 5 wherein said conductor assembly is coupled to, and in electrical communication with, a number of load conductors, and wherein:

said trip assembly includes a GF solenoid control unit; and said GF solenoid control unit structured to actuate said GF solenoid plunger within an effective response time.

13. The circuit breaker of claim 12 wherein said effective response time is a first effective response time.

14. The circuit breaker of claim 12 wherein:

said GF solenoid control unit includes a GF coil, a Programmable Logic Circuit (PLC), and a silicon controlled rectifier/semiconductor-controlled rectifier (SCR) gate drive;

said GF coil disposed about a number of said load conductors and said GF coil structured to generate a GF signal when a ground fault occurs in any said load conductor;

said GF solenoid control unit PLC coupled to, and in electrical communication with, said GF coil, said GF solenoid control unit PLC structured to receive said GF coil GF signal;

said GF solenoid control unit PLC structured to produce an actuation signal upon receiving said GF coil GF signal;

said SCR gate drive coupled to, and in electrical communication with, said GF solenoid control unit PLC, said SCR gate drive structured to receive said GF solenoid control unit PLC actuation signal; and said SCR gate drive coupled to, and in electrical communication with, said GF solenoid, said SCR gate drive structured to charge said GF solenoid upon receiving said GF solenoid control unit PLC actuation signal.

15. The circuit breaker of claim 14 wherein said GF solenoid is not in direct electrical communication with said conductor assembly.

* * * * *